US005577874A

United States Patent [19]

Olsen

[11] Patent Number: 5,577,874

[45] Date of Patent: Nov. 26, 1996

[54] METHOD AND APPARATUS FOR THE TRANSFER OF LOADS FROM A FLOATING VESSEL TO ANOTHER OR TO A FIXED INSTALLATION

[76] Inventor: Torodd E. Olsen, Joh.Falbergetsgate 10, N-5500 Haugesund, Norway

[21] Appl. No.: 302,783

[22] PCT Filed: Mar. 16, 1993

[86] PCT No.: PCT/NO93/00043

§ 371 Date: Sep. 12, 1994

§ 102(e) Date: Sep. 12, 1994

[87] PCT Pub. No.: WO93/18999

PCT Pub. Date: Sep. 30, 1993

[30] Foreign Application Priority Data

Mar. 16, 1992 [NO] Norway ..... 921013

[51] Int. Cl.[6] ..... B63B 27/16

[52] U.S. Cl. ..... 414/138.3; 414/139.6; 414/138.2; 414/138.4; 414/139.7; 212/308; 254/900

[58] Field of Search ..... 414/138.2, 138.3, 414/138.4, 139.6, 139.7; 212/191, 259; 254/900, 337, 399

[56] References Cited

U.S. PATENT DOCUMENTS

| | | | |
|---|---|---|---|
| 3,329,808 | 7/1967 | Fisher | 414/139.7 |
| 4,118,012 | 10/1978 | Kerr et al. | 414/138.4 |
| 4,174,188 | 11/1979 | Brun . | |
| 4,179,233 | 12/1979 | Bromell et al. | 414/138.3 |
| 4,180,362 | 12/1979 | Stair | 414/139.7 |
| 4,277,053 | 7/1981 | Simon | 414/138.4 |
| 4,448,396 | 5/1984 | Delago . | |
| 4,544,137 | 10/1985 | Johnson . | |
| 4,629,365 | 12/1986 | Kuriiwa . | |
| 4,666,357 | 5/1987 | Babbi | 414/138.5 |
| 4,838,522 | 6/1989 | Calkins . | |
| 4,919,393 | 4/1990 | Calkins . | |

FOREIGN PATENT DOCUMENTS

| | | | |
|---|---|---|---|
| 7436712 | 6/1976 | France . | |
| 2388754 | 11/1978 | France | 414/139.6 |
| 904502 | 2/1991 | Norway . | |
| 448714 | 3/1987 | Sweden . | |
| 1255508 | 7/1986 | U.S.S.R. | 414/138.2 |
| 2091678 | 8/1982 | United Kingdom . | |
| 2096563 | 10/1982 | United Kingdom | 254/900 |

*Primary Examiner*—Karen B. Merritt
*Assistant Examiner*—Douglas Hess
*Attorney, Agent, or Firm*—Townsend and Townsend and Crew LLP

[57] ABSTRACT

A method and apparatus for the transfer of loads from a vessel that moves with heavy seas to a stationary or mobile installation by the use of at least one lifting cable and at least one hoisting mechanism, where the load, in a starting position, stands on a rack on the vessel. The load transfer takes place at an instant when the load has only insignificant kinetic energy, as the gripping mechanism is activated in a controlled manner at the instant to lock the load to the lifting cable. At the same instant the rack collapses and immediately establishes a distance between the load and the vessel, thereby suspending the load on the lifting cable.

14 Claims, 16 Drawing Sheets

37
1
38
4
39

37
42
41
40
39
38

1
44

METHOD AND APPARATUS FOR THE TRANSFER OF LOADS FROM A FLOATING VESSEL TO ANOTHER OR TO A FIXED INSTALLATION

The invention relates to a method for transfer of loads from a vessel that moves with heavy seas to a stationary or mobile installation, by the use of at least one lifting cable or wire and at least one hoisting means, where the load in its starting position stands on a rack on the vessel.

The invention also relates to an apparatus for transferring a load movable in a substantially vertical direction to a temporarily stationary suspending means such as a cable or string at an instant when the load has no significant kinetic energy.

The invention relates also to a method for constructing an oil platform on a Jacket or support structure positioned on the sea bed, preferably with the aid of the method and apparatus mentioned above.

In connection with Norwegian patent no. 159 186 and with patent application NO 894 762, further developmental work has been carried out with the objective of devising a method for direct installation of modules from a ship to a platform in accordance with the construction method previously described in the above cited patent publication. There has also been developed a type of platform consisting of a system of easily mountable and dismountable modules, deck and equipment which may easily be mounted directly from barges or a supply ship on the field without using floating cranes.

The methods currently in use today for offshore load transfer, by lifting loads from a ship to fixed or mobile installations, involve subjecting the lifting gear as well as the loads to some very significant dynamic stresses in that the loads are transferred whilst they are in motion, and consequently have high kinetic energy.

In the transfer of smaller loads, for example service goods and support equipment for production platforms and drilling rigs, the dynamic forces are absorbed by existing cranes and lifting gear with the aid of hydraulic cylinders and hydraulic accumulators, so-called heave compensators. Also, the cranes currently used on board oil platforms are limited to weights of 15–80 tons.

In lifting of heavier equipment, such as modules, foundation frames, manifold stations, etc., having weights from 100 to 7000 tons, the dynamic forces will be so considerable that lifting with cranes placed on the platforms is not practically feasible. Such weights are currently only lifted with floating cranes of various types. Most of these cranes are also equipped with hydraulic compensator systems to dampen the effect of the dynamic loads.

A major disadvantage with the use of contemporary lifting equipment is it physical size and the fact that the lifting and load handling must take place over other equipment. This entails particular limitations with respect to access, for example, in installation of equipment or modules situated under the platform.

Furthermore, the lifting of heavier units over the vital parts of the platform, such as processing plants, etc., means that processing must be stopped for security reasons during the period in which lifting takes place. The financial consequences of this can be very considerable.

In addition, the huge floating cranes must be mobilized and anchored at the platform. This involves special complications when the sea bed around the platforms is overlaid with pipeline systems, manifolds, etc., which can be damaged by anchors and chains. Furthermore, the crane vessel will normally require the assistance of 2–4 tugboats or supply ships for the anchoring, etc. Barges are needed to bring out modules and heavier equipment—usually one standard barge with a 10,000 ton displacement, pulled by two tugboats or supply ships.

The mobilization time and mobilization costs, in addition to operating costs for this equipment, are quite significant, even though the lifting operation itself takes only a short time.

Therefore, current methods establish clear limitations, both technically and financially, for direct lifting operations onto platforms or drilling rigs.

The limitations mentioned above are overcome by the present invention, which permits load transfer directly from a ship or barge to a platform, from ship to ship or from ship to drilling rig without any significant influences of dynamic loads. The equipment of which the invention consists is lightweight, and may be positioned on or under the platform by means of simple auxiliary units.

With the aid of the invention a special platform type and method of construction has been developed, namely a platform with depending modules that fulfills all requirements for simple, inexpensive and flexible assembly, replacement of modules and later dismounting.

There are no known limitations as to the weights that can be handled in accordance with the method.

The method is particularly designed for load transfer in connection with rebuilding and or construction of oil platforms, and the transfer of loads such as foundation frames, satellite stations, modules, etc.

The present method utilizes a principle based on carrying out a load transfer at the moment in time when the load does not have any significant kinetic energy.

The energy of the load, as is commonly known, is proportional to the square of the velocity at the moment of load pick-up, expressed by the formula:

$$W=\tfrac{1}{2}*m*V^2$$

The vertical speed of the object to be lifted is a function of the ship's movements, and given the fact that the ship follows the motion of the wave, the velocity for regular waves is a sine function with a period of about 4 to 8 seconds in the transfer situations that have been calculated.

The theoretical method for load transfer should thus be to seize the load at the instant it is at the top or the bottom of the wave and is therefore without any vertical velocity component.

In purely practical terms, it is only conceivable to do this while the load is on the top of the wave, due to the risk of collision between the ship and the load if the lifting speed is slower than the ship's vertical velocity in the wave.

For this purpose, a method and apparatus have been developed to ensure that the load is transferred in the described manner.

In accordance with the present invention, there is provided a method of the type described in the introduction, which is characterized in that the load transfer takes place at an instant when the load has only insignificant kinetic energy, as at least one gripping means is activated in controlled manner at said instant to lock the load to the lifting cable, and at the same instant, the rack collapses and immediately establishes a distance between the load and the vessel, thereby suspending the load in the lifting cable.

In accordance with the invention there is also provided an apparatus of the type mentioned in the introduction which is characterized in that It comprises at least one gripping means and a sensor device that registers when the movement of the load reverses at said instant, which sensor device emits a signal that controllably activates the gripping means to lock the load to the suspending means at the same instant.

In accordance with the present invention there is also provided a method for the construction of an oil platform as mentioned in the introduction, which is characterized in that the platform is constructed by the hoisting of large building modules directly from a mobile vessel up from below through the main frame system of the platform for installation between the main frame system or on the top thereof.

Additional features of the Invention are disclosed in the dependent claims.

Other additional objectives, features and advantages will be apparent from the following description of the invention, which is provided for the purpose of description without thereby limiting the invention, and are presented in connection with the attached drawings, where:

FIG. 1 shows an apparatus according to the invention which is a part of the equipment used to carry out a load transfer, FIG. 2 is a diagram illustrating the placement of a plurality of apparatuses according to the invention to execute a load transfer from a vessel to a stationary installation, FIG. 3 shows the apparatus according to FIG. 1 in further detail and partial section, FIG. 4 is an enlargement of an alternative embodiment of the apparatus shown in FIG. 3, FIG. 5 shows an alternative method of undertaking compensation for a wave movement for the lifting gear, FIG. 6 shows still another alternative lifting and compensating arrangement, FIG. 7 shows in further detail a collapsible support structure, FIG. 8 shows an alternative embodiment of the collapsible support structure shown in FIG. 7, FIG. 9 illustrates the use of the method according to the invention for installation of a module from below and into an existing oil platform, FIG. 10 illustrates use of the method for installation of a module to a platform from a vessel on the exterior of the module frame, with the aid of a lifting frame, FIG. 11 illustrates a construction method for oil platforms showing the first phase of the construction, FIG. 12 shows the installation of the utility module that constitutes the next phase of the construction, FIG. 13 shows the utility module mounted and depending from the platform's projecting beams, FIG. 14 shows the platform after mounting is completed.

Figure 1:
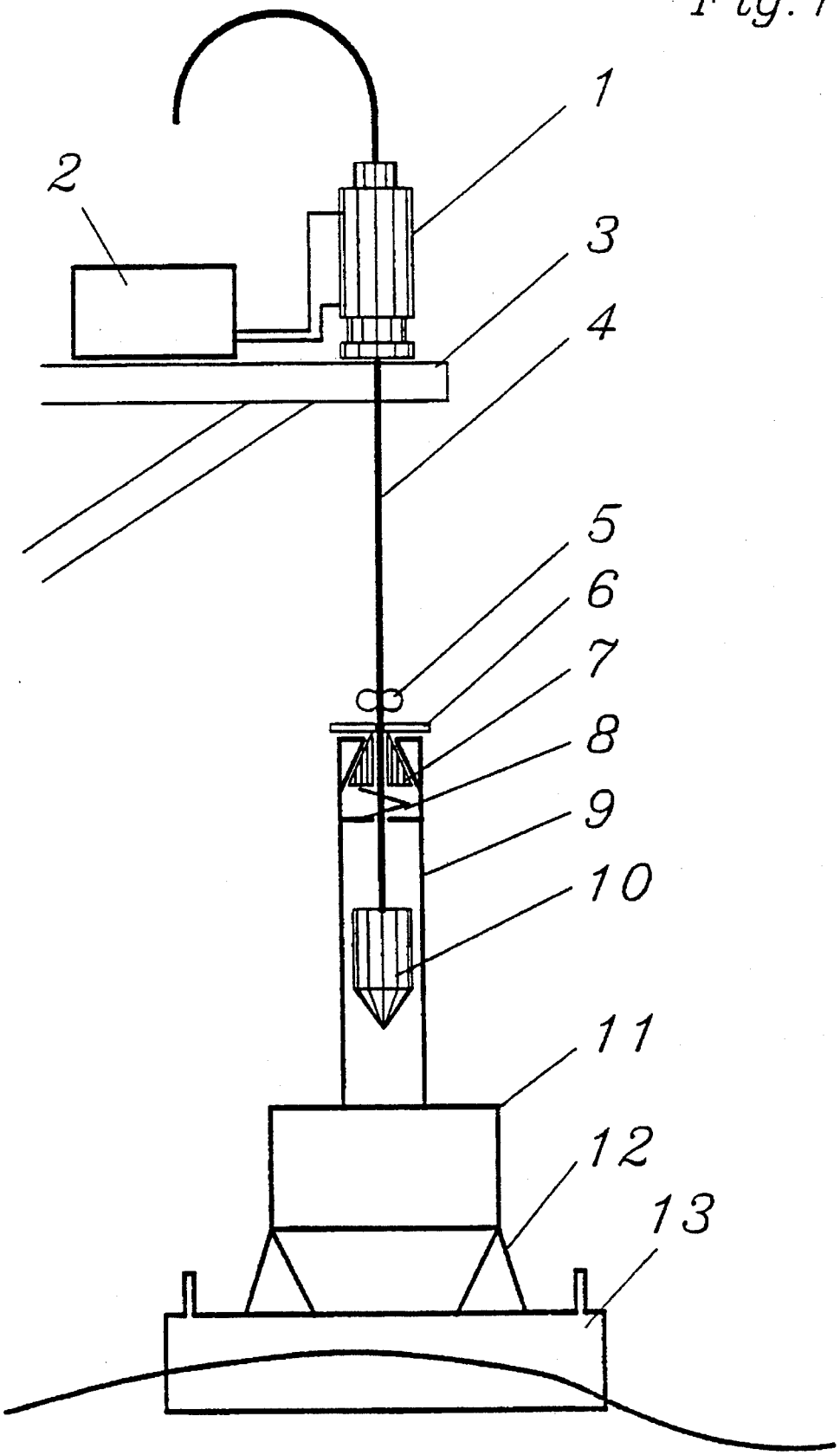

The system consists of the following main elements as shown in FIG. 1:

The lifting gear 1 may consist of an ordinary crane, drum winch or linear lifting mechanisms that obtain their power from a hydraulic power pack 2.

From the lifting device 1 runs a suspending means 4 consisting of one or more individual wires or lines passing through a gripping means having a gripper mechanism 7, to a weight 10 that holds the suspending means taut. The gripper mechanism 7 is connected to the load 11, which may consist of a module, a deck, an equipment package or the like. Load 11 is placed on a collapsible support structure 12 which stands on the vessel 13. Several forms of gripper mechanisms such as clamps or Jaws are conceivable, but mechanisms having self-inducing function are particularly preferred: i.e., mechanisms that clamp harder and more securely the greater the load is.

The principle shown illustrates that by means of a special control device for the gripper mechanism 7, it will be possible to transfer the load to the suspending means while the load is at a standstill, i.e., at the top of the wave movement.

The system includes a controlled press plate 6 which holds the gripper mechanism 7 open until it is activated by remote control at a point in time determined by the speed and direction recording instrument 5.

On activation of the press plate 6 the gripper mechanism 7 is triggered with the aid of a spring 8. This causes means 4 to be locked against upward movement relative to the gripper mechanism 7 so that load 11 remains suspended by the means 4.

In the following are shown the main principles of the technical design of the equipment used for installation of modules directly from a vessel.

Figure 2:
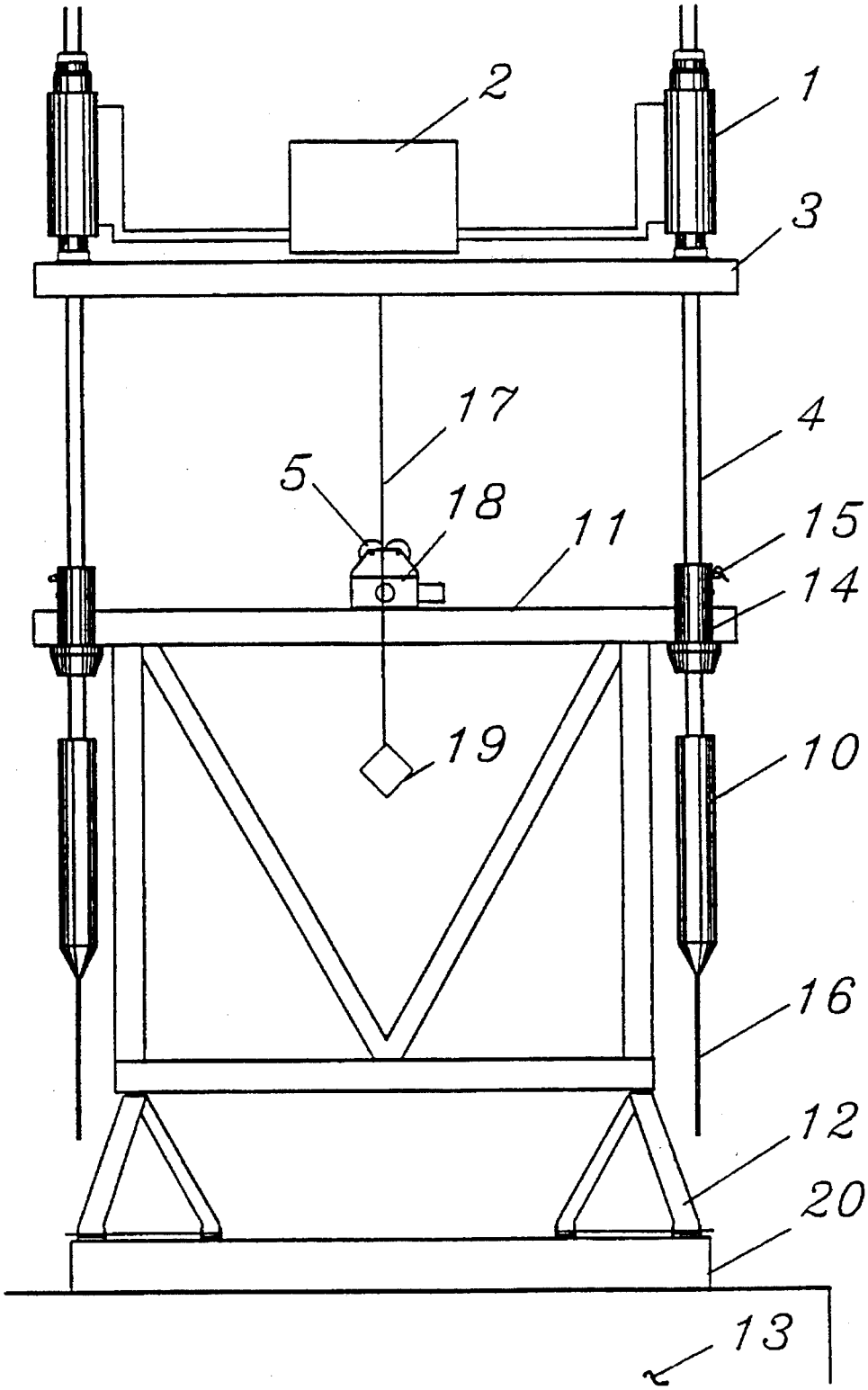

FIG. 2 is a sectional view of the main components of the equipment arranged for installation of a module. These consist of lifting gear 1, hydraulic power pack 2, controlled gripping means 14, cable weight 10, the supporting means being cables, positioning instrument 5, collapsible support structure 12 and vessel 13.

The functional principles are as follows:

Mounted on or within the platform 3 is the lifting gear 1, for example, linear hoisting machines, drum winches or suitable hoisting equipment. From the lifting gear 1 are lowered, to within a few meters above sea level, lifting cables 4 on which weights 10 have been mounted to hold them taut, and so-called pilot cables 16, i.e., lightweight steel cables or hawsers that the vessel crew can use for handling the weights.

The ship 13 has been fitted with a transport frame 20 having collapsible support legs 12 for supporting the module 11.

In the lifting procedure, the ship 13 is positioned below the lifting gear 1 with the aid of the instrument package 18 that registers the position and movement of the ship in relation to the platform. The positioning equipment may be of various types: mechanical with the aid of a so-called piano wire 17 suspending a weight 19 from the platform, by shortwave acoustic signals, light, lasers or by visual registration.

The vessel's movements are registered on the bridge, and are evaluated in relation to the calculations forming the basis for the lifting operation.

The operation starts with the use of the pilot cables 16 to guide the weights 10 and gripping means 14 into placement at the module's lift points. During this period the gripper mechanism 7 is not activated, and the lifting cables 4 may pass freely through the gripper mechanism 7. If the position and movement are within given parameters, the ship's captain will release the gripper mechanism 7 with the aid of, for example, electrically controlled powder charges or hydraulic, pneumatic or manual triggers 15.

The mode of operation of the gripper mechanisms 7 is such that they can be activated only while the load undergoes an upward movement. Also, after being activated, the gripper mechanism only permits the cable to run freely in the downward direction relative to gripper mechanism 7, which means that the cable is locked immediately on a directional change.

This principle enables the module to be lifted along the cable 4 of the vessel during the wave motion to the top of the wave. At the instant the vessel begins to move downward, module 11 will be suspended from the cable, and is lifted free of the support legs 12.

The support legs 12, which are collapsible, are activated and fold down rapidly so as to establish a distance between the vessel and the module. This is of major importance for preventing collision between the vessel and the load when the vessel is lifted by the next wave and, in addition, floats higher in the water due to the removal of the load.

The vessel leaves its position, and the module may be hoisted up and secured to the platform.

Figure 3:
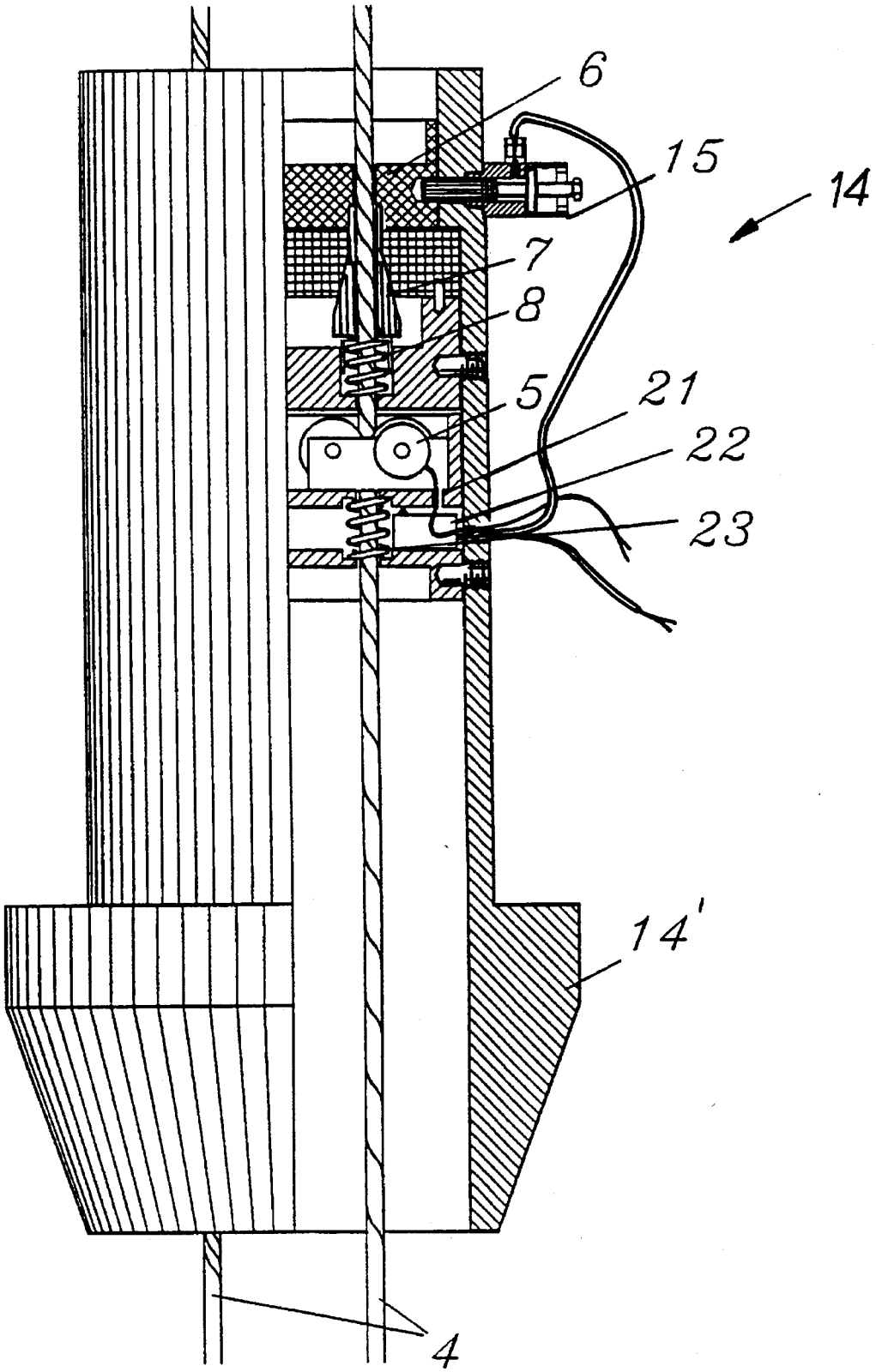

FIG. 3 shows the principle for one embodiment of a gripping means 14 in the form of a gripper mechanism 7 with movable wedges, or keys.

There are several different ways to arrange the gripping means 14 and trigger system. In FIG. 3 an alternative is illustrated where the gripping means is freely suspended on the cable system.

The gripper mechanism itself 7 is enclosed in a housing or harness 14', serving partly as a holder for the gripper keys, and partly as a simple connector for attachment to the load with the aid of, for example, a so-called bayonet coupling. Through harness 14 runs one or more lifting cables or wires 4 which at the upper end thereof are attached to the lifting gear, and at the lower end may be connected to a cable weight 10 that holds the wires taut, and which overcomes the frictional forces in the gripper keys and measuring/recording instrument 5.

The mode of function for the gripping means 14 is as follows:

In open position (deactivated state), the press plate 6 is pressed down and locked by a trigger 15. Press plate 6 in this position holds the gripper keys 7 open to allow the cables 4 to pass freely therethrough.

The recording instrument 5 has two functions:

a.) to register the vertical movement in the form of the speed and direction of the load relative to the cable 4, and b.) to activate a microswitch 22. This is done by the resistance to rotation of the wheels of instrument 5 causing recording plate 21 to be pressed against a spring 23, which alternately turns the microswitch on and off depending on whether the movement is upward or downward.

This function may also be carried out electronically with the registration of the upward/downward movement in the signals from the recording instrument 5.

Activation of the gripper mechanism can take place through the transmission of an electrical signal from the bridge. The signal may be sent regardless of whether the load is on the way up or down, since microswitch 22 stops the signal from reaching the trigger mechanism 15 until the load is moving upward relative to the cables. When the signal reaches the trigger mechanism 15, a powder charge is ignited, the safety catch is released, and press plate 6 is lifted up by springs 8, which simultaneously push the gripper keys upward and into contact with cable 4.

At the instant cable 4 begins to move upward relative to gripper keys 7, these are locked while undergoing a movement of 5–10 mm, which corresponds to the vertical movement for the load before the weight is transferred to the cable system. The wires will stretch slightly under the load, with 30–50 mm found to be normal for module lifting. The vertical speed attained by the load at this point in the movement is insignificant.

Figure 4:
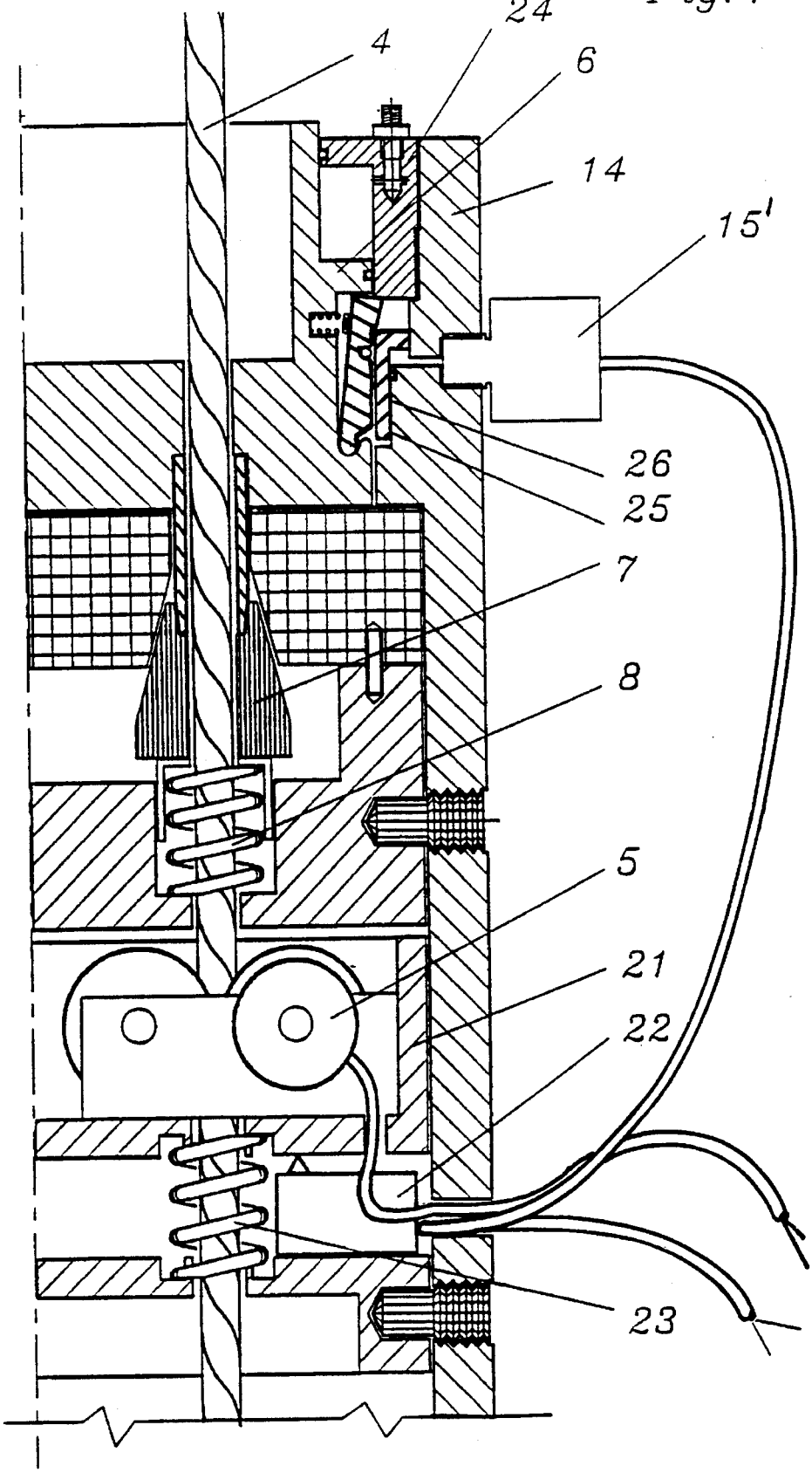

In FIG. 4 an alternative arrangement of the press plate 6 and trigger mechanism is illustrated. This arrangement increases the safety of the release in that more than one activator 15', consisting of powder charges, hydraulic pressure, etc., may be involved.

The system functions such that press plate 6 is provided with a groove in which are disposed a series of locking lugs 25 which in locked state are pressed against a stopper ring 24. In the housing 14' for the gripper mechanism is disposed a piston 25 and one or more electrically controlled powder charges or solenoid valves connected to a hydraulic pressure source.

When the signal for release reaches the charge(s) or the solenoid valve, piston 25 is pressed upward, and it urges the locking lugs into the groove in press plate 6. The latter is released and is pressed upward by the force of springs 8. This causes the gripper keys to be pressed inward against cable 4, thereby locking it.

Rapid release of the load, i.e., on loading a module from a platform down to a vessel, for example, is made possible by pressing the press plate 6 downward and into locked position.

Figure 5:
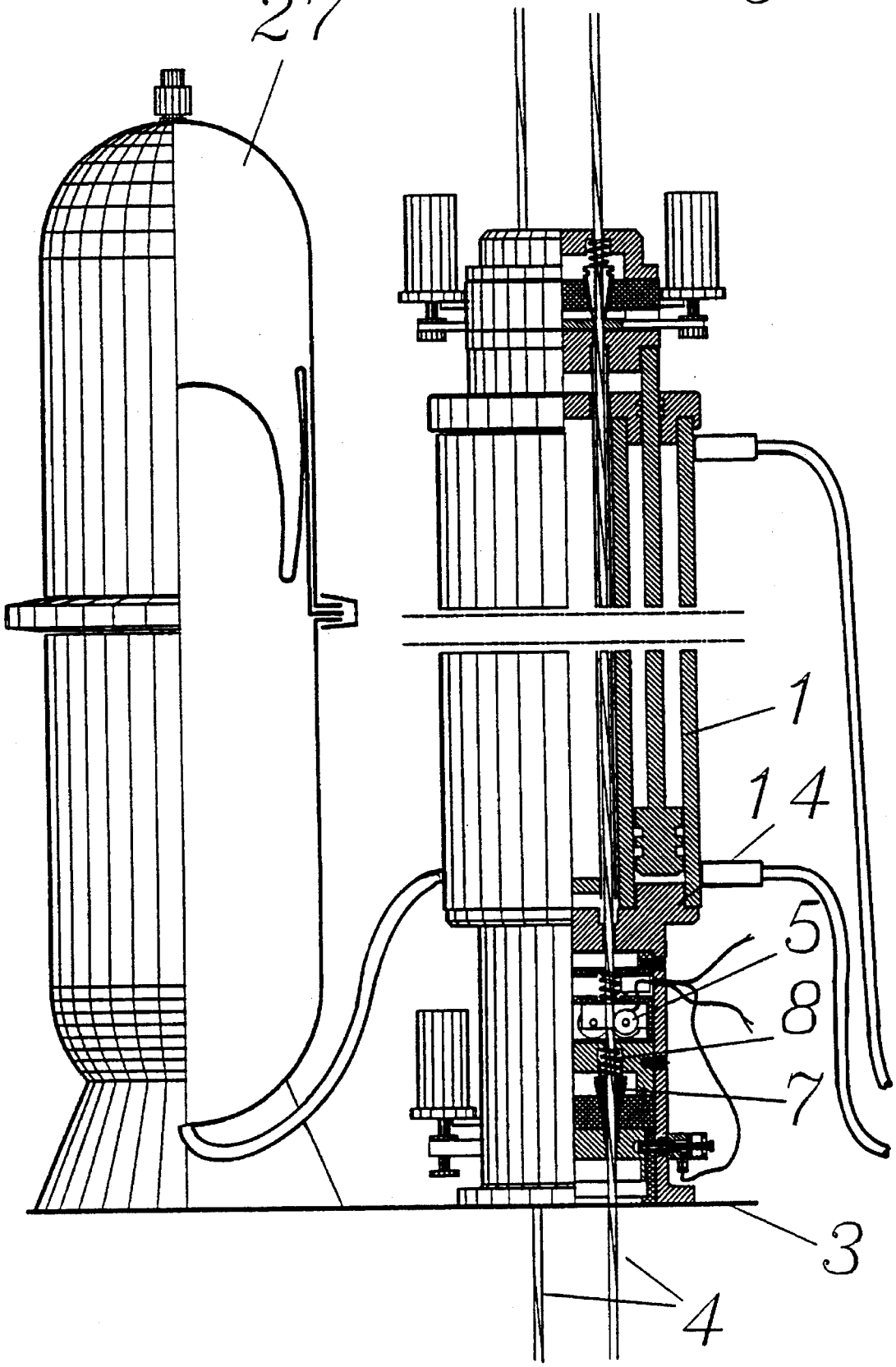

FIG. 5 shows an alternative method of undertaking compensation for the wave movement in the lifting system.

The lifting machine 1, which stands on a platform 3, is combined with a hydraulic accumulator 27 that allows the piston of the lifting machine, and with it the cables which are locked by the two upper gripper keys, to move in rhythm with the wave movement that the load imparts to the cables 4.

The recording instrument 5, together with the controlled gripper keys, are mounted in connection with the lifting machine 1 by means of the housing, or harness 14'.

This system is also invertible, enabling the lifting machine to mounted down by the module if this should be desired.

Figure 6:
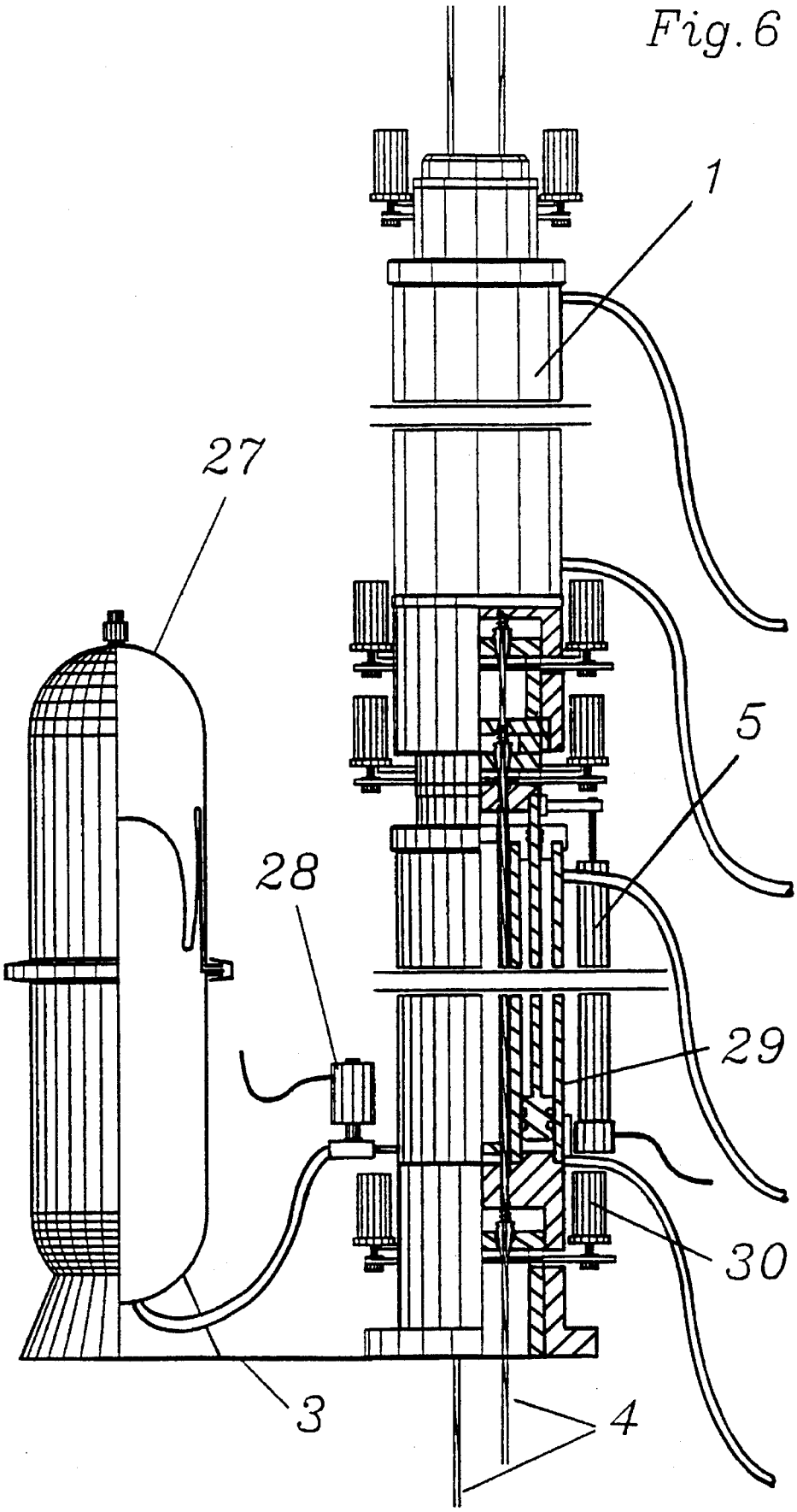

FIG. 6 shows an alternative lifting and compensation arrangement consisting of two lifting machines 1 and 29 which operate in tandem. The machines are placed atop one another, and cables 4 run through them both. One of the machines may be used for lifting and lowering, for example, while the other compensates for motion. This function may also be assigned to the upper machine 1. The machine responsible for wave compensation 29 is equipped with a recording instrument 5 for motion and direction as well as an ordinary actuator 30 for control of opening and closing of the gripper mechanism in lifting and lowering operations.

The rapid lock mechanism, which is designed to stop the movement when the load is at its highest point in the wave, consists of a controlled valve 28 that shuts off the flow of hydraulic oil from the lifting machine 29 to the accumulator 27 when activated in accordance with the principles and equipment previously described.

The equipment illustrated in FIG. 6 may be mounted in inverted sequence, i.e., connected to the load instead of positioned up on the platform.

Figure 7:
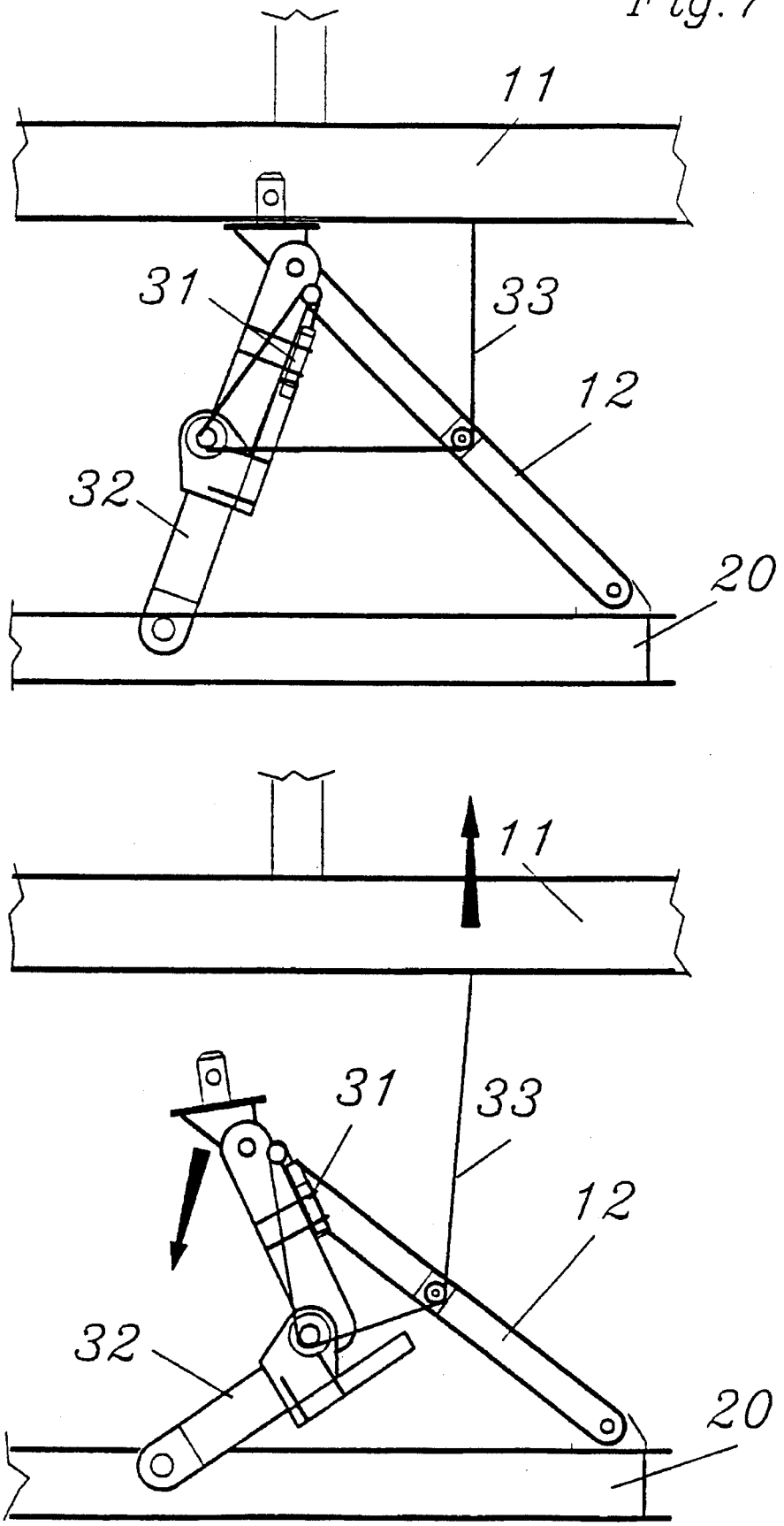

When the load is taken over by the cable system, the load will be lifted from the collapsible support structure shown in FIG. 7.

This illustration is one of several examples of how the collapsible support structure may be arranged.

To the module 11 is fastened a release cable 33 which is connected via pulleys to a lock bolt 31 holding the structure locked in raised position. When module 11 is lifted, the release cable 33 pulls out lock bolt 31 and simultaneously assists in collapsing the structure's legs 32, so that the brace 12 is laid down parallel with the structural frame 20. When the module 11 is lifted from the ship, there is an alteration in both trim and displacement. This means the ship deck will now be resting higher in the water than in its loaded state. When the ship is again lifted up by the waves, the collapsible support structure will prevent collision between the module and ship.

Figure 8:
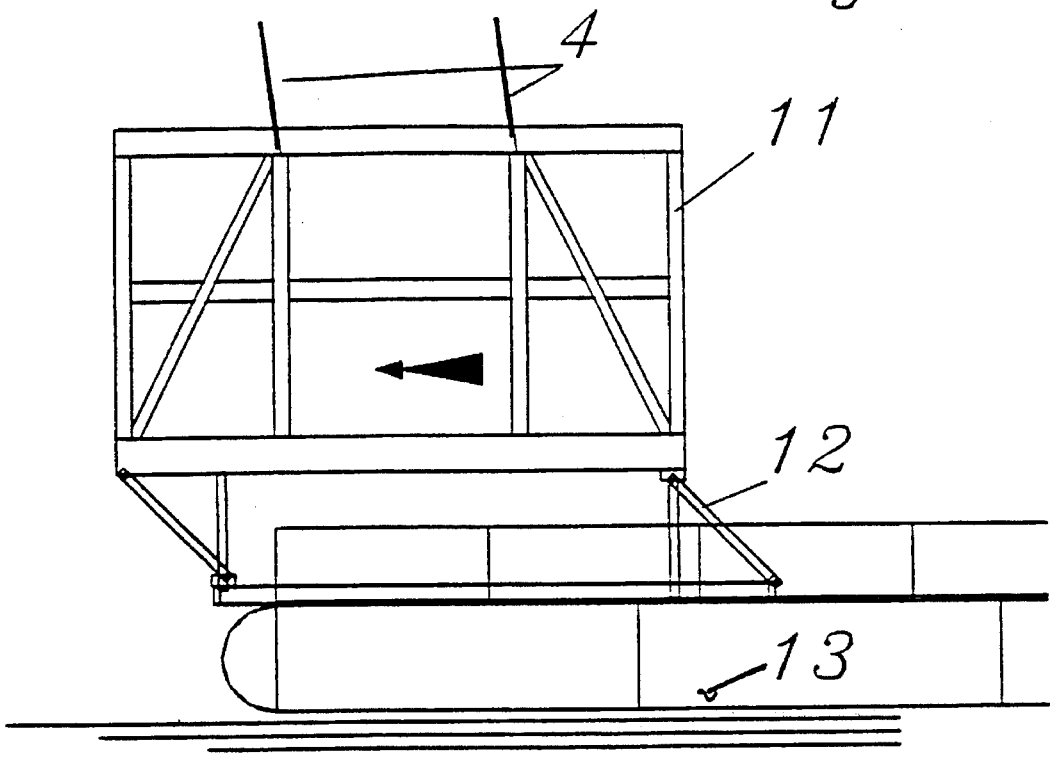
Figure 8:
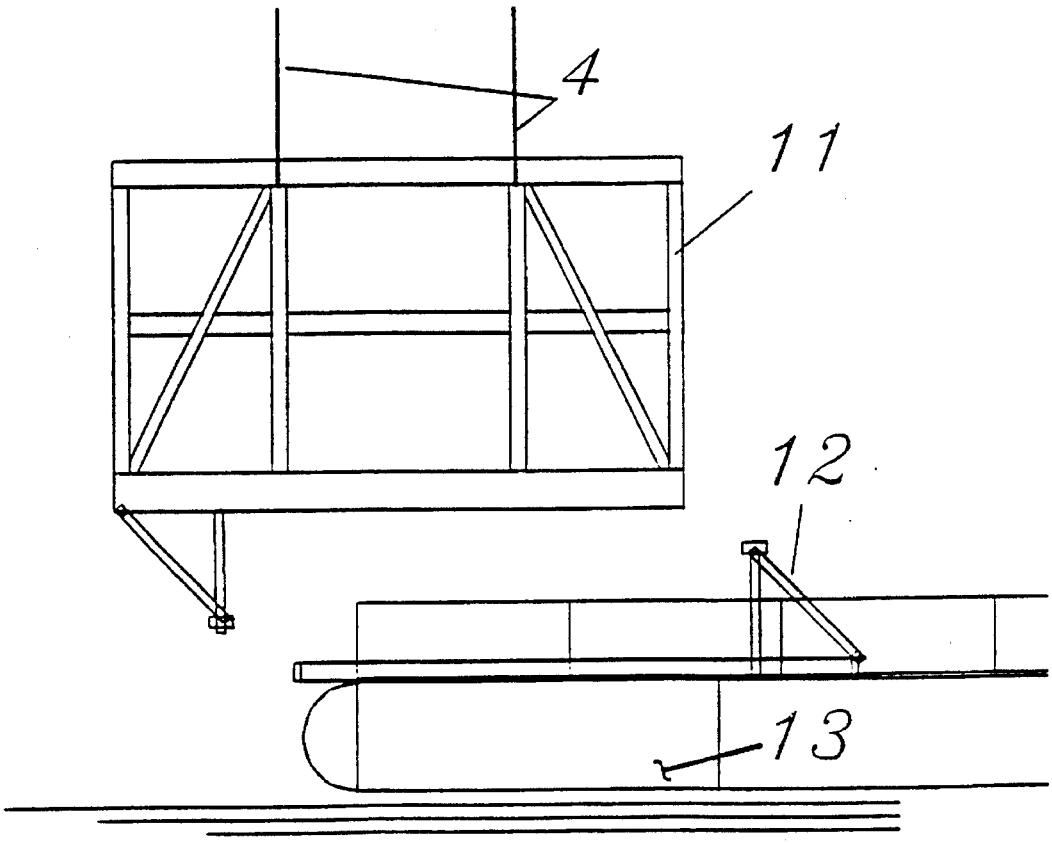

FIG. 8 shows an alternative method of arranging the support structure to avoid collision between load and vessel when unloading.

Cables 4 may be suspended at a slight angle, which on lifting will impart to load 11 a small power component aftward or laterally relative to vessel 13. The support structure 12 is arranged in such manner as to create a sufficient distance between the load and the vessel during lifting. This is achieved most advantageously by dividing the structure 12, as shown, so that one part moves with the load and will lie outside the vessel after lifting, while the part situated on the vessel ends up on the outside of the load when the load is hoisted up.

Figure 9:
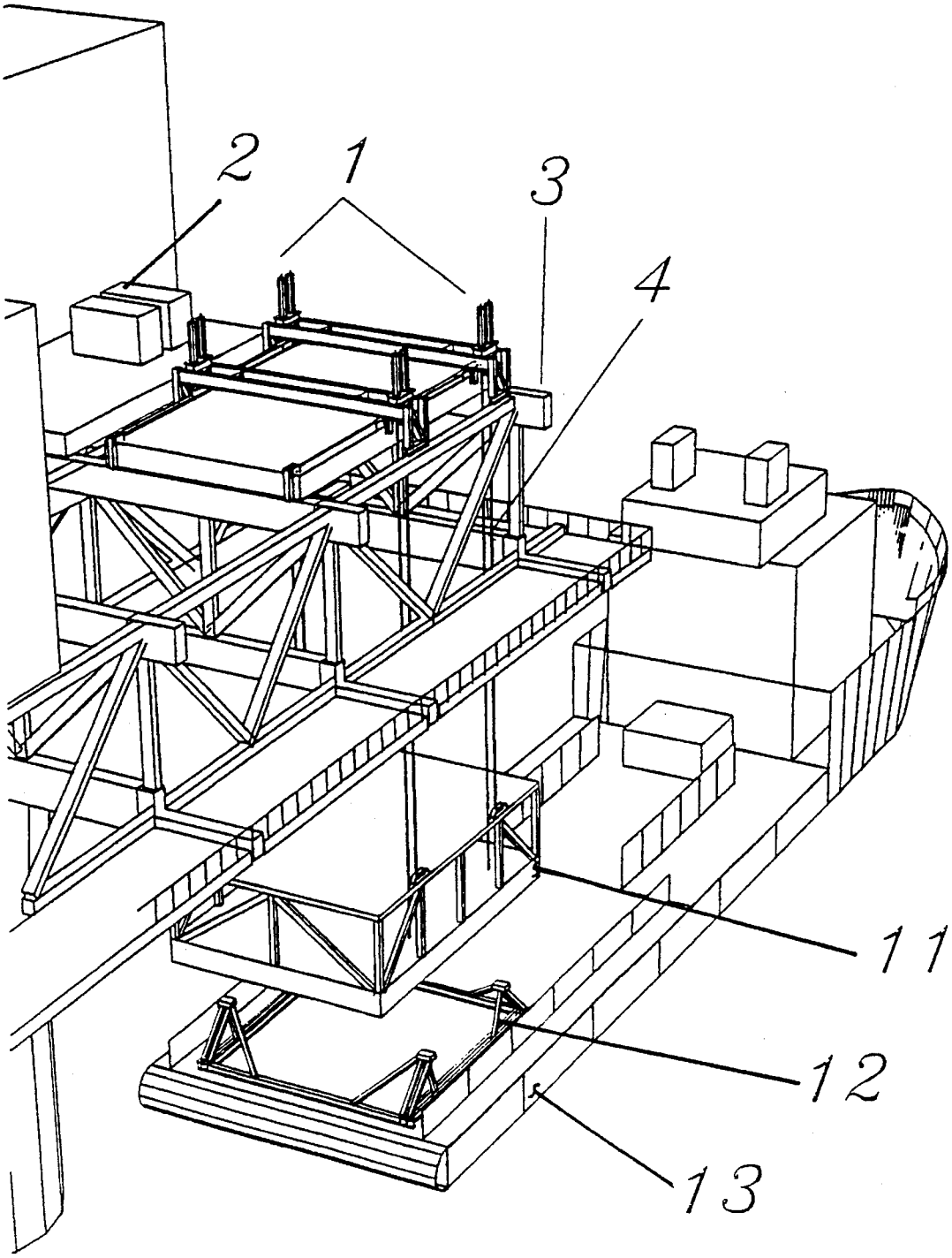

FIG. 9 shows that the principle may be used for installation of a module from below and into an existing oil platform in accordance with Norwegian Patent No. 860856.

Module 11 arrives at support structure 12 by means of ship 13, and is positioned below the platform module deck 3, on which lifting machines 1 are installed on mobile frames and receive their power supply from the aggregates 2.

The module is hoisted as described earlier in FIGS. 2–4, and is moved horizontally in and up onto module deck 3 where the module is secured to the module deck 3 or is suspended therefrom.

Figure 10:
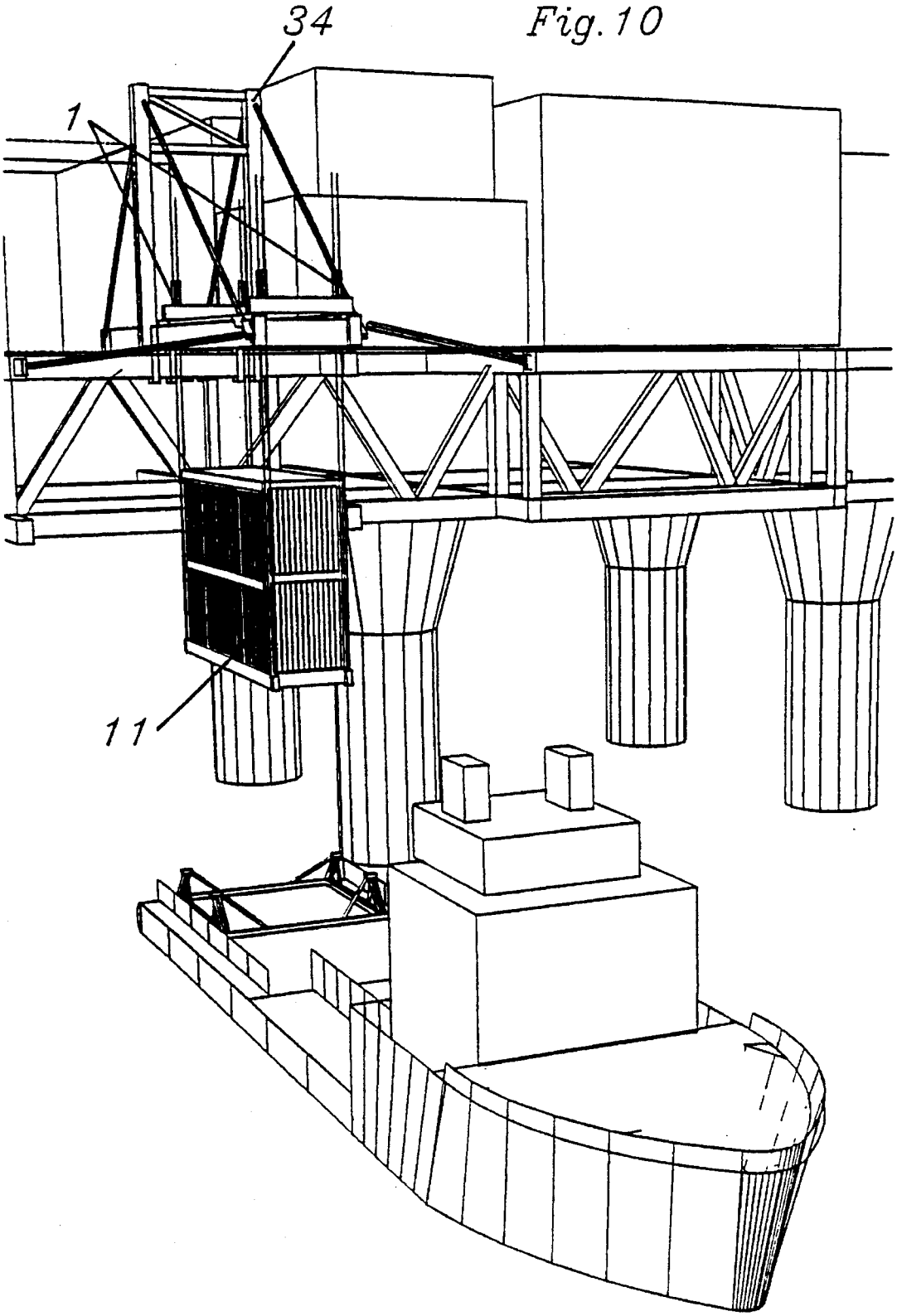

FIG. 10 shows the invention used for installation of a module onto a platform from a vessel, on the outside of the module frame or Jacket and thereupon, or up onto existing modules with the aid of a lifting frame.

Module 11 arrives with the vessel, is positioned under the lifting frame 34 and lifted up by means of lifting machines placed on the lifting frame. With this method the module 11 is lifted through and up onto the lifting frame 24, and is then moved in onto the module deck.

The invention as described has given rise to a new design and construction method for oil platforms, as described in the following.

The costs connected with installation of oil platforms offshore or on land can be quite considerable, particularly due to the need to use large floating cranes. This is particularly true for platforms of a smaller size, where the cost of installation is especially high in relation to the total construction cost of the platform.

Therefore, in the following we have chosen to present a design and construction method which can be fully executed without the use of floating cranes.

The platform may be built entirely as a framework of steel, the so-called "steel Jacket" platform, or with a substructure of concrete, a so-called "gravity base" platform.

Figure 13:
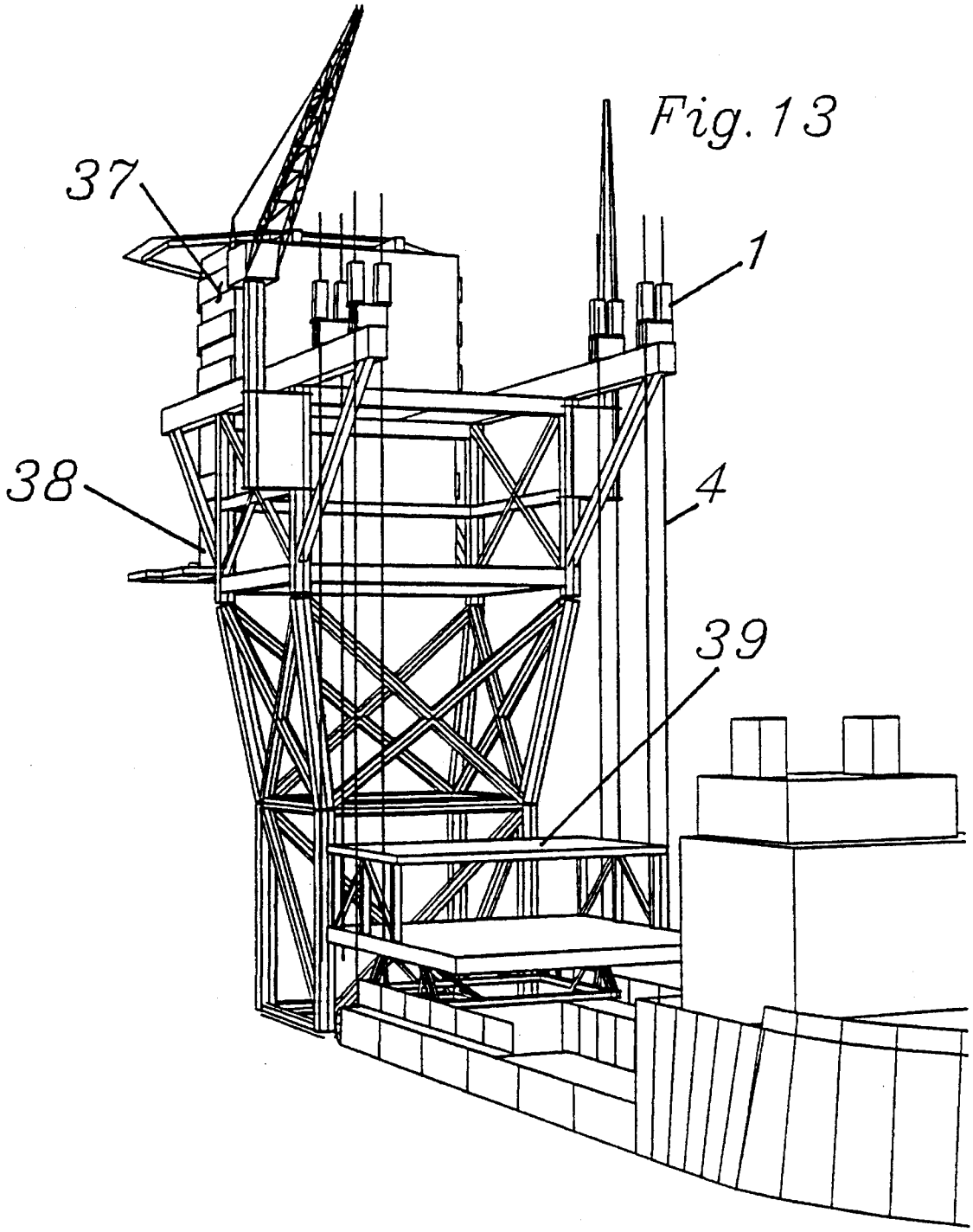
Figure 14:
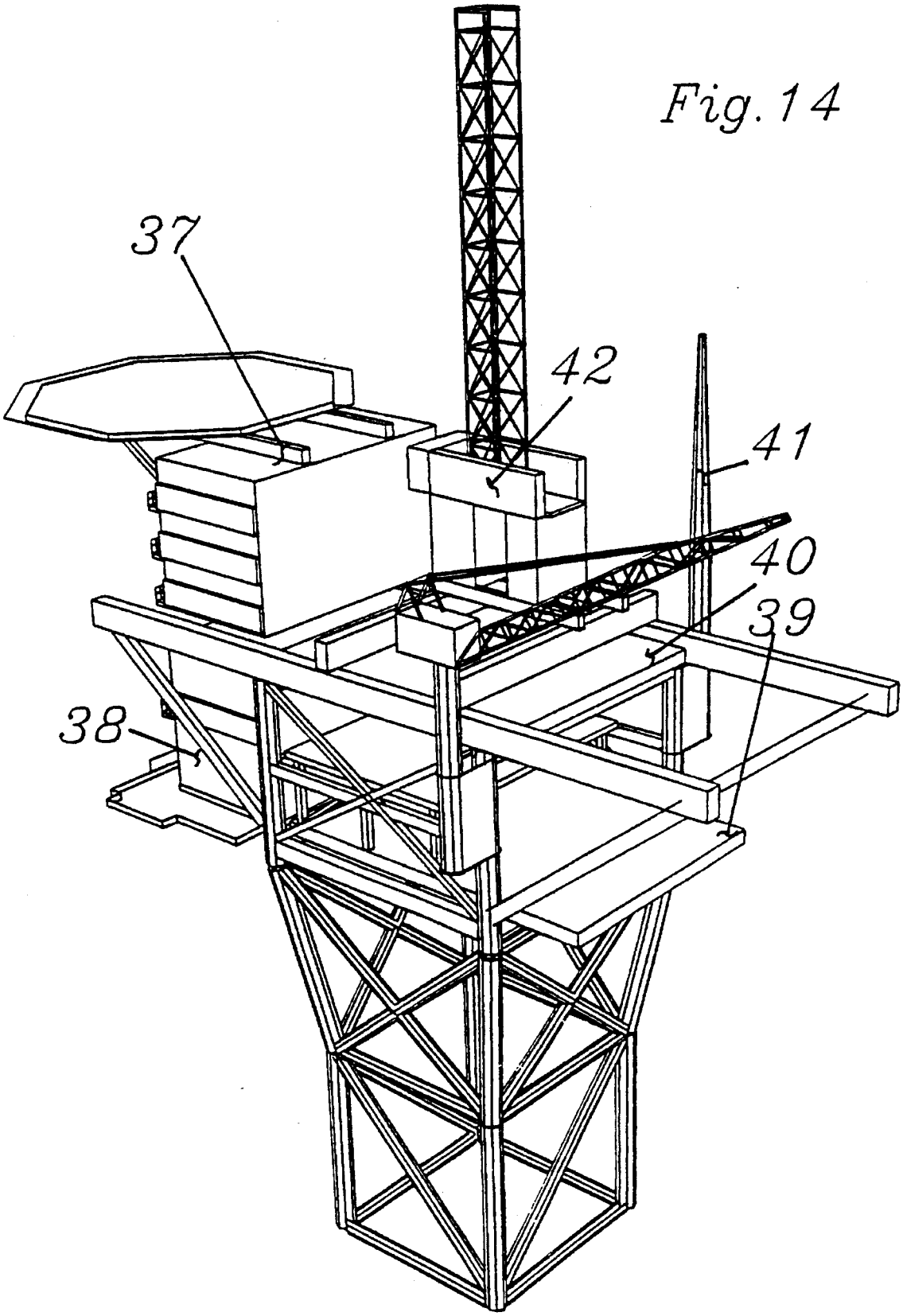
Figure 15:
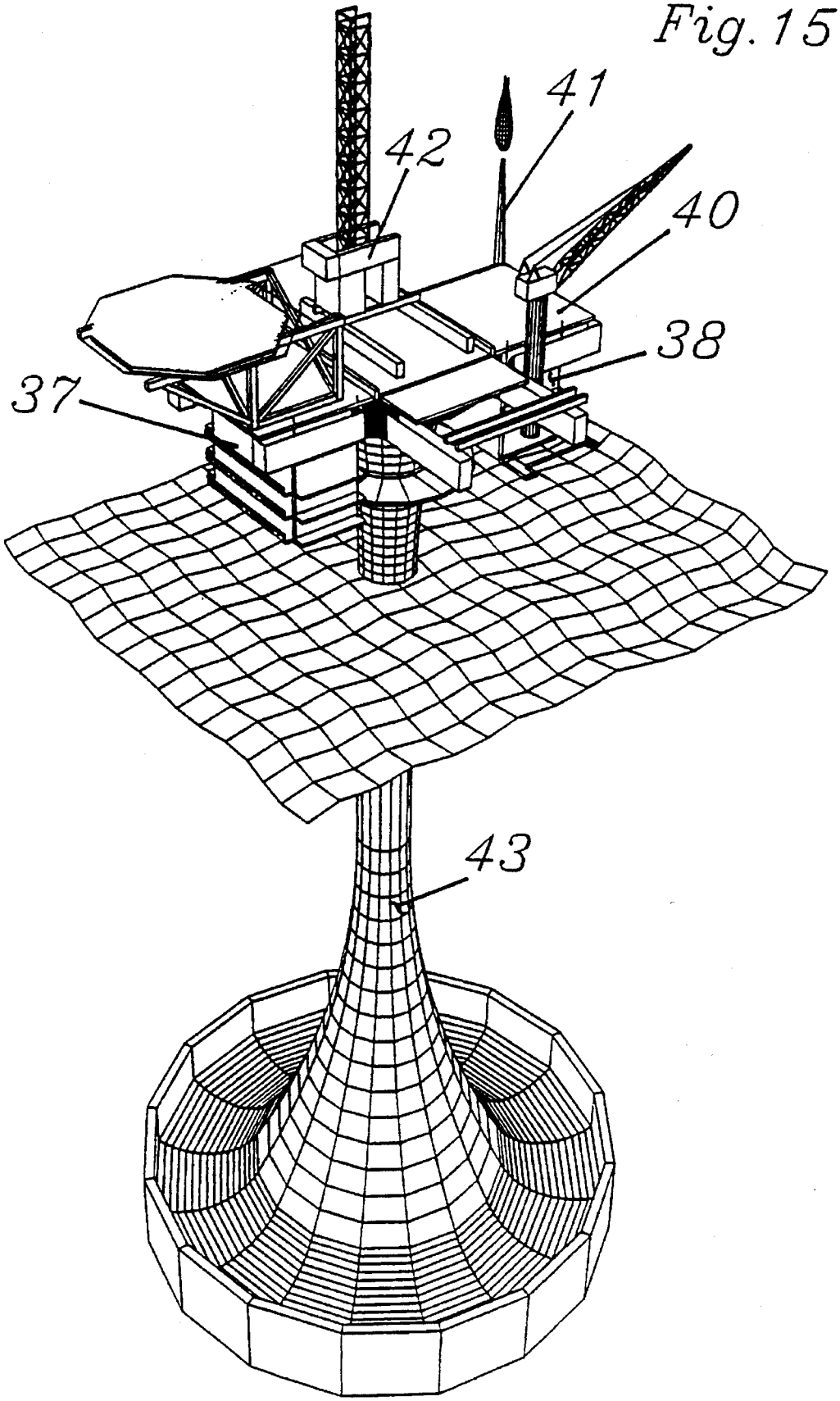
FIG. 15 shows a platform that is installed on a concrete base.

We have chosen to show a design and construction method used for a lightweight wellhead platform of steel in FIGS. 11–14, and as a wellhead platform in concrete in FIG. 15.

Figure 11:
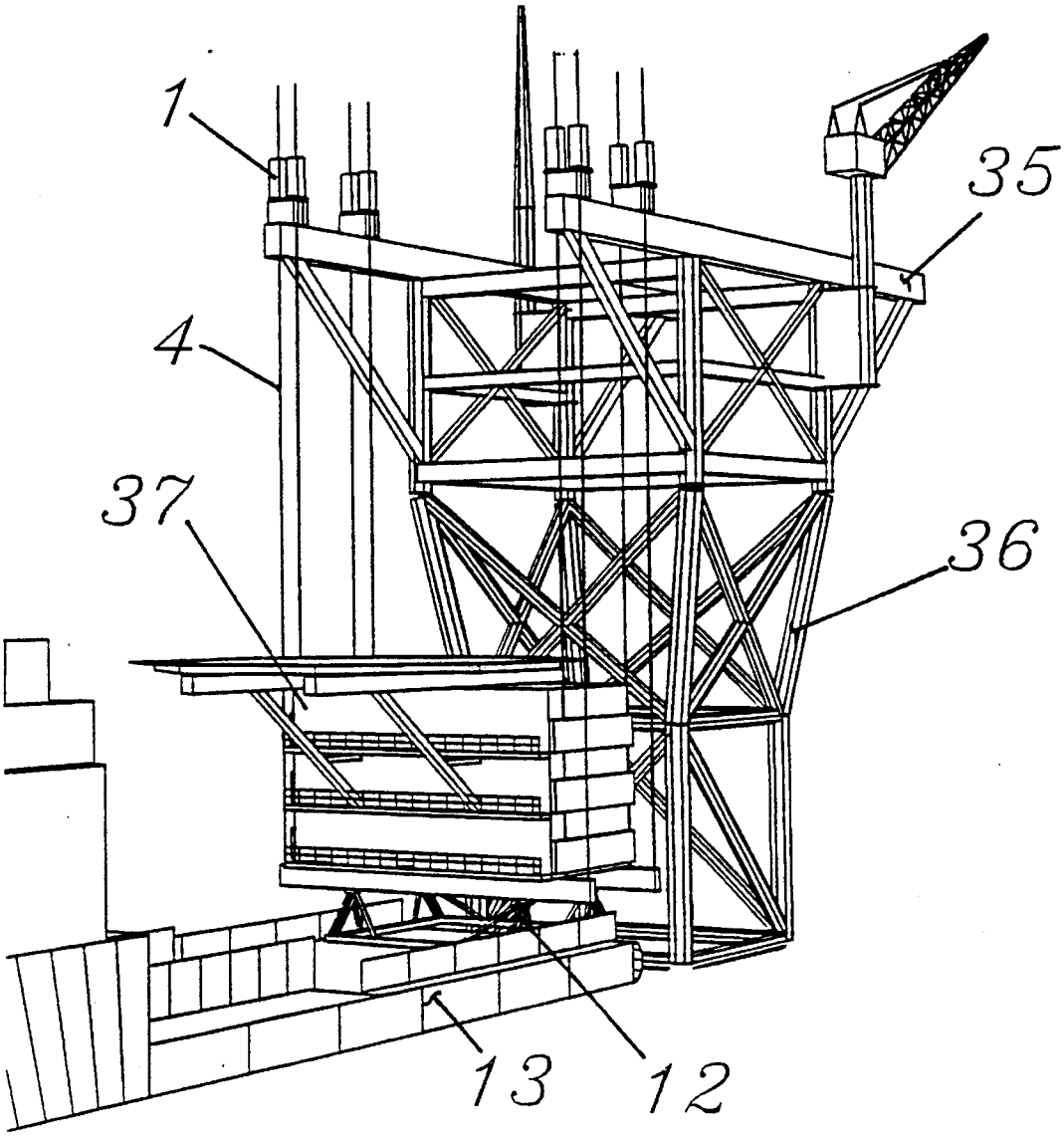

FIG. 11 illustrates the first phase of construction.

The platform's frame or jacket 36 is built with projecting support beams or skids 35 mounted on the top or somewhat further down on the Jacket or frame. Normally it will also be possible to install a crane and flare tower prior to the installation of the jacket on the oil field.

Jacket 36 is installed on the field by launching directly from barges, and it is held and positioned with the aid of floats fastened to the jacket. Launching the jacket and securing it to the sea bed, so-called piling, can be done by drawing the Jacket down toward the bottom—preferably over pre-drilled wells—with the aid of the lifting machines, and steering it into position on piles sunk in the sea bed.

The modules and deck intended for the platform arrive on supply ships or barges for installation as follows:

The platform's own diesel motor driven cranes hoist the lifting gear 1 into place with cables 4. The vessel 13 preferably arrives first with the living quarters module 37 or the helicopter deck, which is lifted up by means of the method described earlier. The module may be lifted up through the frame system and positioned thereon, or it may be mounted to be freely suspended from the support beam 35. This is a matter of choice.

The advantage of installing the helicopter deck and living quarters module first is obvious, for the installation crew can live on the platform and be transported by helicopter from the mounted helicopter deck.

Figure 12:
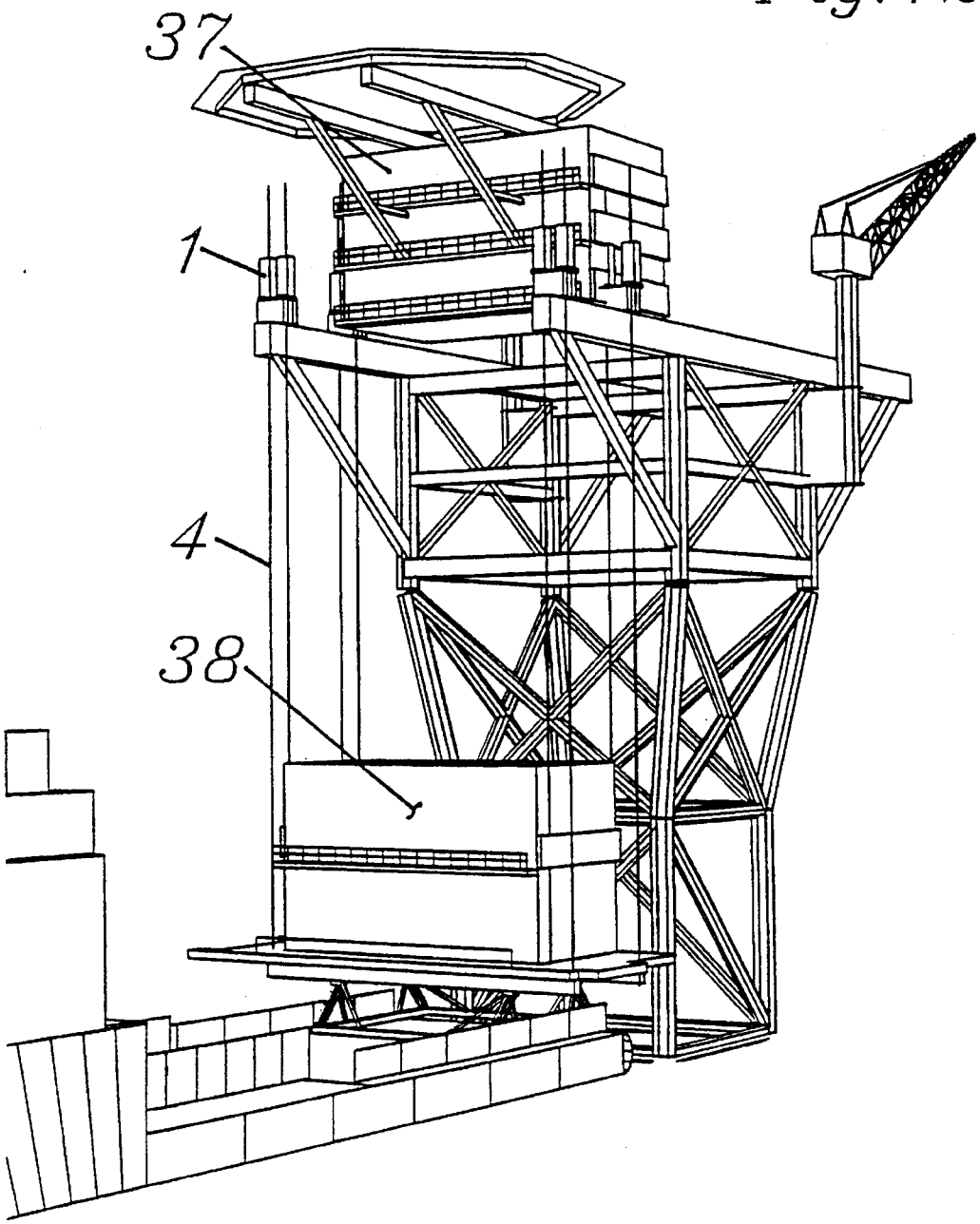

FIG. 12 shows the installation of the utility module 38, which is hoisted into place with the aid of lifting machines 1 and cables 4, as previously described. Note that the utility module in this case is a top-suspended or depending module. This is a new method by which to mount modules, affording a reduction in the steel weight of the module, as well as facilitating its replacement or dismounting in the case of conversion or removal of the entire platform.

FIG. 13 shows the utility module 98 mounted on and depending from the platform's projecting beams. From this position it may later be replaced/removed by reversal of the lifting process.

The equipment deck 29 with a wellhead Christmas tree, pipe systems, etc. installed thereon is mounted directly from a vessel as shown, and is moved horizontally into place within the platform if desired.

FIG. 14 shows the platform fully mounted. The living quarters module 37, with the helicopter deck, is mounted highest and atop the lifting frames. The utility module 38 is mounted for top-suspension below the living quarters module.

The equipment deck 39 with its intermediate deck and equipment is mounted within and between the platform frame system, and the weather deck 40—which may serve as a storage area for drill pipes, etc.—is mounted between the platform's lifting frames. On the lifting frames it is possible for the drilling and well maintenance equipment 42 to be moved. The flare tower 41 can be mounted to best advantage on the outside of the frame system, enabling the frames or skids to be used freely for lifting gear or drilling rigs 42.

As is apparent from the illustration, the platform design and construction method is very flexible with respect to mounting and replacement of modules, decks, equipment, etc., by means of the frame system and the described lifting principle.

FIG. 15 shows the wellhead platform described above designed with a concrete base.

It is important to emphasize that the platform may be built with a beam system of steel or concrete according to choice, and that the modules may be designed as suspended modules or standing modules as desired.

The platform may be mounted on the field, for example, as merely a concrete structure that is floated out onto the field without modules.

This results in better stability and lower buoyancy requirements than for platforms having modules mounted thereon. Here there is an implication of considerable cost savings, particularly for platforms for use at great sea depths.

This platform is very simple to mount: the modules are positioned on the outside of the concrete shaft and are thus situated very securely with respect to possible blowouts or fires in the processing plant. The platform is constructed with suspending or dependent modules, making it possible for the modules to be replaced or removed easily and facilitating the disassembly or, if necessary, the moving of the platform. The suspended modules have a lower steel weight than standing modules, and may be constructed and mounted considerably more inexpensively by means of the described method.

Figure 16:
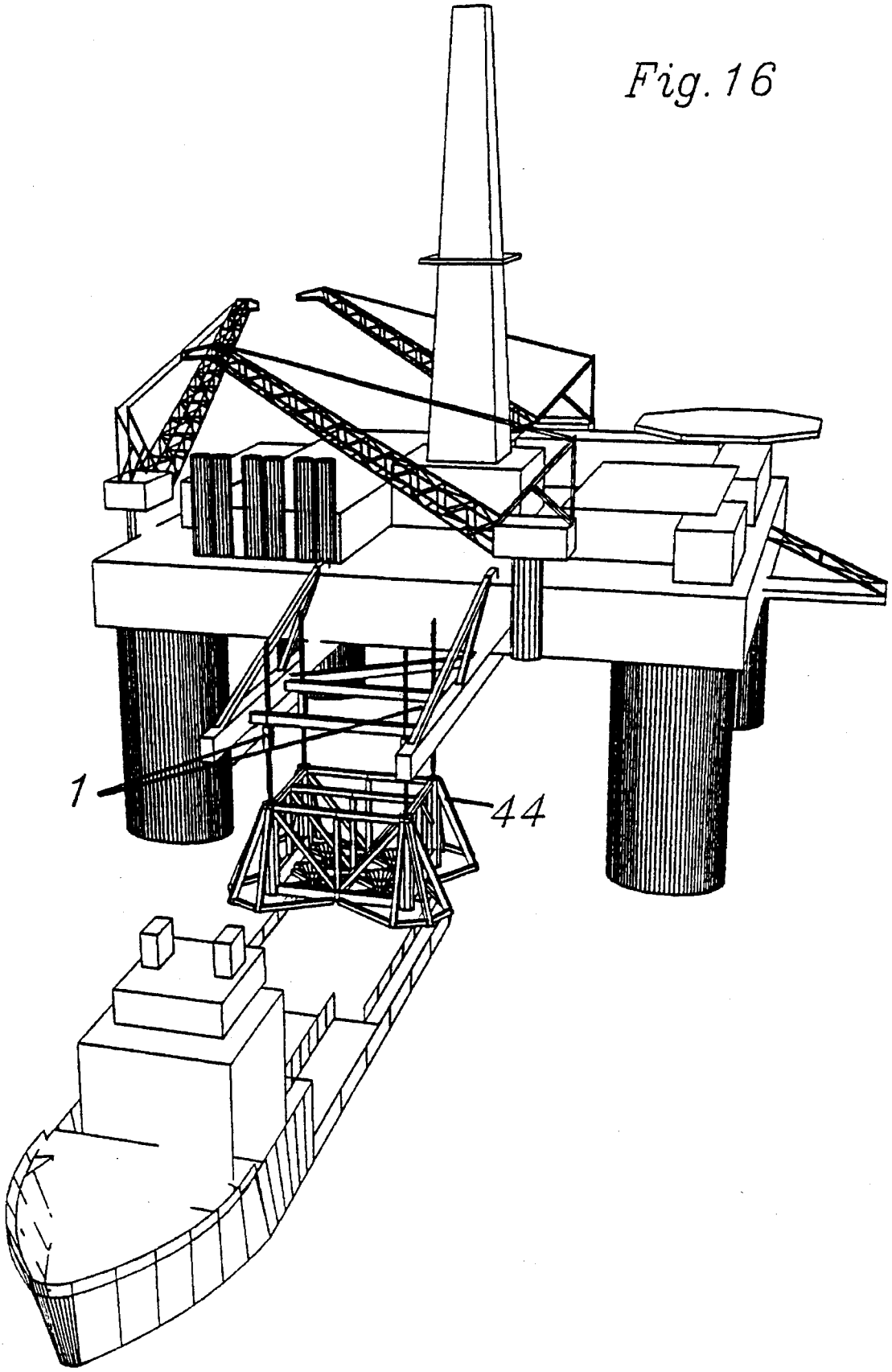
FIG. 16 shows an application of the method for installation of foundation frames, manifold stations, satellites, etc.

FIG. 16 shows an application of the method for installation of foundation frames, manifold stations, satellites, etc., by means of drilling rigs, tension leg platforms, or the like. The method consists of transferring the equipment to a drilling rig or platform in accordance with the invention, instead of using crane vessels to set the equipment on the sea bed. Thereafter the installation onto the sea bed from the platform is carried out either by means of the lifting gear associated with the drilling rig, or with the aid of the hydraulic lifting machines previously described.

I claim:

1. Apparatus for transferring a load movable in a substantially vertical direction to a temporarily stationary suspending means at an instant when the load has no significant kinetic energy, the apparatus comprising at least one gripping means, a recording or sensing device which registers when the movement of the load reverses at said instant, said sensing device, after a prior command, emitting a signal that controllably activates the gripping means for locking the load to the suspending means at the same instant, the gripping means including a housing which encloses the suspending means, said gripping means further comprising a gripper mechanism including keys which are held at a starting position in spaced relationship to the suspending means, while nearly enclosing the suspending means, and which on activation releases a press plate enabling the keys to lock the load to the suspending means on a specific direction of movement of the load or the suspending means.

2. Apparatus for attaching a load which cyclically moves up and down to a stationary cable suspended from an installation, the apparatus comprising a housing adapted to be attached to the load; a gripping member mounted to the housing and movable between a first position in which the gripping member permits relative movement between the cable and the housing and a second position in which the gripping member prevents relative movement between the cable and the housing and thereby locks the housing to the cable; a sensor for determining relative movement between the cable and the housing and a directionality of the relative movement; and triggering means operatively coupled with the sensor and the gripping member for moving the gripping member from its first position to its second position in response to a reversal of the directionality of the relative movement between the housing and the cable to thereby secure the housing, and therewith the load suspended therefrom, to the cable for subsequent lifting of the load with the cable.

3. Apparatus according to claim 2 wherein the load is carried on a vessel subjected to up and down motions induced by waves, and wherein the triggering means is moved into the second position in response to a signal from the sensor indicating a reversal of the relative movement between the housing and the cable from an upward direction to a downward direction so that the load becomes suspended from the cable when the vessel is on a crest of a wave.

4. Apparatus according to claim 2 including means for maintaining the cable taut.

5. Apparatus according to claim 2 wherein the sensor includes means engaging the cable for sensing relative movement between the cable and the housing.

6. Apparatus according to claim 2 including a hoist mounted on the installation and operatively coupled with the sensor, the hoist lifting the cable upwardly upon activation of the triggering means to move the gripping member to its second position.

7. Apparatus according to claim 2 including a hoist for lifting and lowering the cable, and a hydraulic accumulator operatively coupled with the hoist for compensating relative movement of the load with respect to the installation.

8. Apparatus according to claim 7 wherein the hoist is mounted on the installation.

9. Apparatus according to claim 7 wherein the hoist is mounted on the load.

10. A method of safely lifting a load carried on a vessel subjected to typical vertical up and down motions of the vessel as a result of waves, the method comprising the steps of suspending a cable from a stationary hoist located generally above the vessel; attaching a gripping mechanism disposed about the cable to the load so that the gripping mechanism can move along the cable as the vessel and therewith the load moves up and down relative to the cable; operatively coupling a sensor to the gripping mechanism and the cable; when it is desired to commence lifting the load off the vessel, activating the sensor to sense relative movements between the cable and the gripping mechanism; energizing the gripping mechanism to permit the gripping mechanism to move relative to the cable in an upward direction and, upon a reversal of the direction of relative movement between the gripping mechanism and the cable from an upward direction to a downward direction, to secure the gripping mechanism to the cable and thereby suspend the load from the cable by preventing further relative movement of the gripping mechanism along the cable in said downward direction; and activating the hoist to lift the cable and therewith the gripping mechanism and the load upwardly away from the vessel.

11. A method of transferring a load from a vessel which is cyclically moved in opposite vertical directions by waves to an installation comprising the steps of suspending a suspension member from a hoist mounted on the installation; maintaining the suspension member taut; attaching a gripping mechanism to the load and extending the suspension member past the gripping mechanism so that the gripping mechanism can move up and down relative to the suspension member; sensing relative motion between the suspension member and the gripping mechanism resulting from relative vertical movement between the vessel and the installation; engaging the gripping mechanism and the suspension member to prevent further relative movement between them in a vertical direction in response to sensing a reversal of the relative motion between the gripping device and the suspension member so that the gripping device secures the load to the suspension member; and thereafter activating the hoist to lift the suspension member and therewith the load away from the vessel.

12. A method according to claim 11 wherein the step of suspending comprises suspending a cable from the hoist.

13. A method according to claim 11 including the steps of providing a support between the vessel and the load which positions the load a predetermined distance above a support surface of the vessel, and reducing a height of the support when the load becomes suspended from the suspension member.

14. A method according to claim 13 wherein the step of reducing the height comprises the step of collapsing the support.

* * * * *